US005913600A

United States Patent [19]

Lin

[11] Patent Number: 5,913,600

[45] Date of Patent: Jun. 22, 1999

[54] SUSPENSIBLE CHRISTMAS LIGHT

[76] Inventor: Mei-Lu Lin, 56, Min Sheng St., Feng-Yuan City, Taichung 42041, Taiwan

[21] Appl. No.: 09/076,037

[22] Filed: May 8, 1998

[51] Int. Cl.[6] ..... F21V 21/00

[52] U.S. Cl. ..... 362/391; 362/249; 362/396

[58] Field of Search ..... 362/249, 250, 362/252, 391, 396, 806

[56] References Cited

U.S. PATENT DOCUMENTS 5,481,444 1/1996 Schultz ..... 362/391 X 5,531,411 7/1996 Adams ..... 362/396 X

*Primary Examiner*—Stephen Husar

[57] ABSTRACT

A Christmas light suspensible from more than one linear object is provide. The light includes a tubular receptacle including a hollow interior with contact plates and a partition therein for receiving a base of a lamp which includes a pair of contact wires and a central notch respectively engageable with the contact plates and the partition of the receptacle, a pair electrical wires connected to the contact plates and extended out of the receptacle through a pair of longitudinal apertures and an elongate notch centrally formed in a rear end of the receptacle between the apertures including a hook of triangular section at the opening of the notch so as to define a slope narrow entrance for the notch.

1 Claim, 4 Drawing Sheets

SUSPENSIBLE CHRISTMAS LIGHT

BACKGROUND OF THE INVENTION

The present invention relates to christmas lights and more particularly to a suspensible christmas light which includes a suspension device in the rear end for enabling the christmas light to be suspended from a linear object such as a wire or a cord.

During christmas-tide or in garden party the christmas light are decorated with a christmas tree or other object. For increasing amushment and ornamental effect, people always adopt strung up christmas lights to skillfully arrange a picture, a pattern or a symbol on a linear object, so that the lights have to go many turns and curves and to attach to their string or other wire or card. To accommodate such requirement, a suitable suspension device has to be provide in the rear end of the light. FIG. 1 shows a suspensible christmas light which includes a receptacle 1, a base into which a bulb 3 in embedded, a pair of electrical wires 4 and 5 connected respectively with a pair of contact plates inside the receptacle 1 and a transverse notch 6 of rought U-shaped section formed in the rear end of the receptacle 1 for disposing a linear object 7 from which the light suspends. Because, the notch 6 has a narrower opening so that the linear object 7 is not so easy to disengage with tthe notch 6. However, a slightly strong drag may disengage the light with the linear object. Besides, the notch 6 can not receiving more than one linear object that reduces the capability of the light on decoration arrangement.

The suspensible christmas light of the present invention generally comprises a receptacle including a pair of contact plate therein connected with pair of electrical wires which are stretching out of the rear end of the receptacle and an elongate notch centrally formed in the rear end and having a hook of triangular section at the opening of the notch, and a lamp which includes a bulb embedded into a base with a pair of conact wire exposed to outside of the bottom of the base so when the lamp frictionally disposes into the receptacle, the contact wires will respectively engage with the contact plates inside the receptacle. The christmas light of the present invention has been characterized in the elongate notch which is capable of receiving more than one linear objects and the hook at the opening of the notch can effectively prevent the linear object from breaking away.

Aaccordingly, the present invention has a main object to provide a suspensible christmas light which includes an elongate notch in a rear end for suspending the light from one or more linear objects and preventing the light from breaking away of the linear objects.

Another object of the present invention is to provide a suspensible christmas light in which the elongate notch is insulated from the contact plates so as to prevent from any possible electrical shock.

The present invention will become more fully understood by reference to the following detailed description thereof when read in conjunction with the attached drawings.

DETAILED DESCRIPTION OF THE PREFERRED EMBODIMENT

Figure 1:
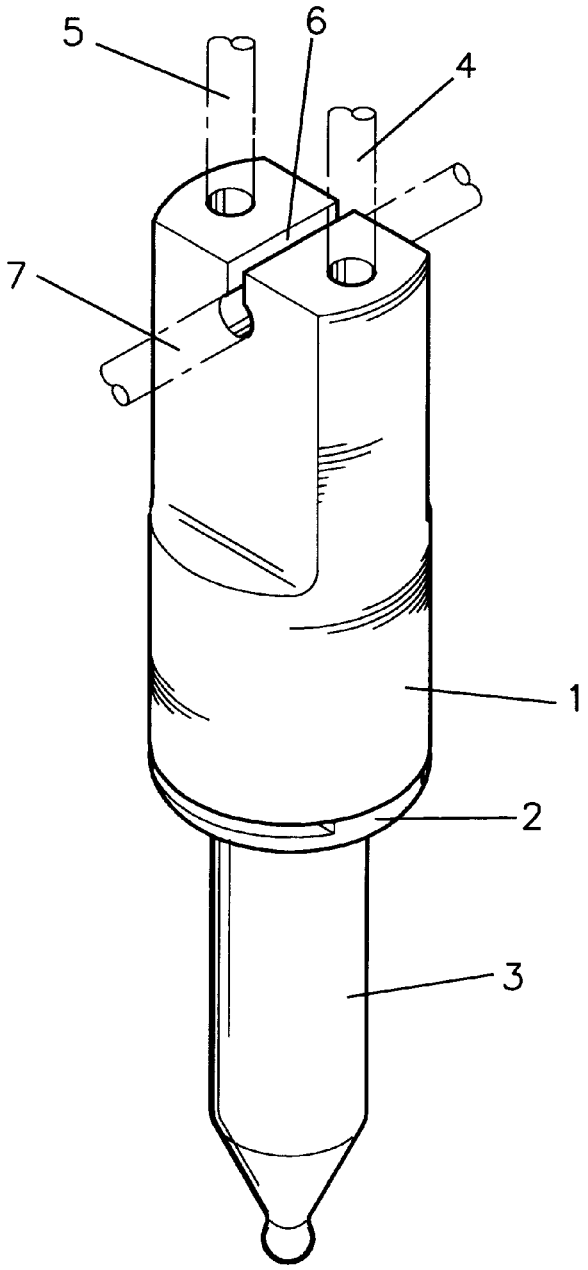
FIG. 1 Prior Art
FIG. 1 is a perspective view of a prior art christmas light.
Figure 2:
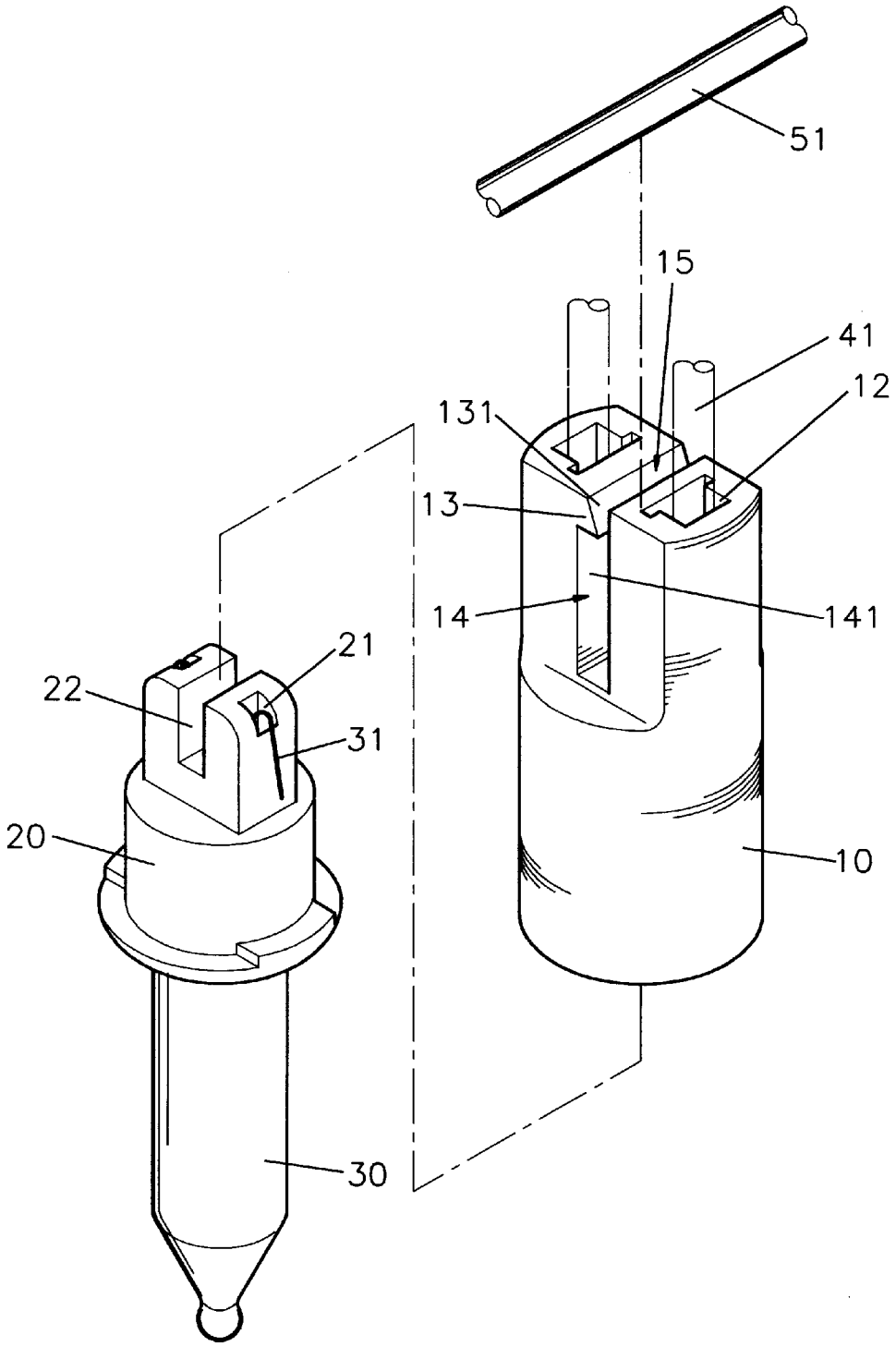
FIG. 2 is an exploded perspective view to show the preferred embodinent of the present invention.
Figure 3:
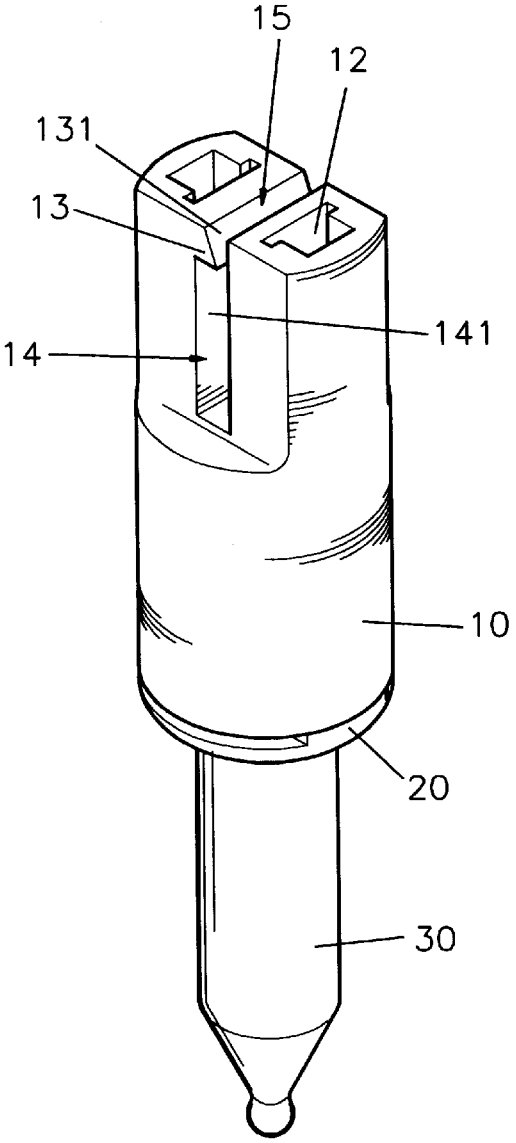
FIG. 3 is a perspective view to show an assemblage of FIG. 2.
Figure 4:
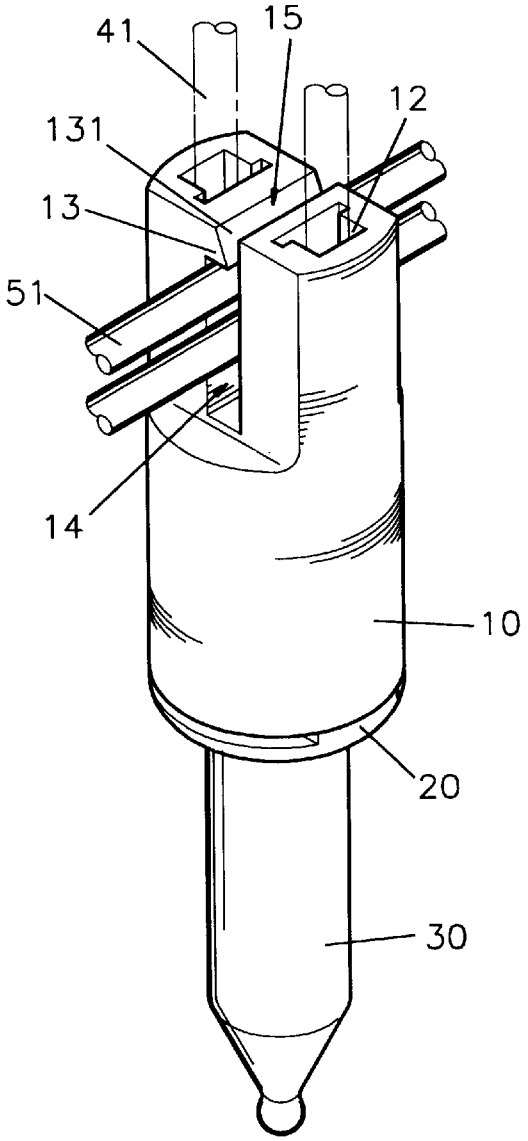
FIG. 4 is a perspective view to show that the christmas light of the present invention is suspended from more than one linear objects.
Figure 5:
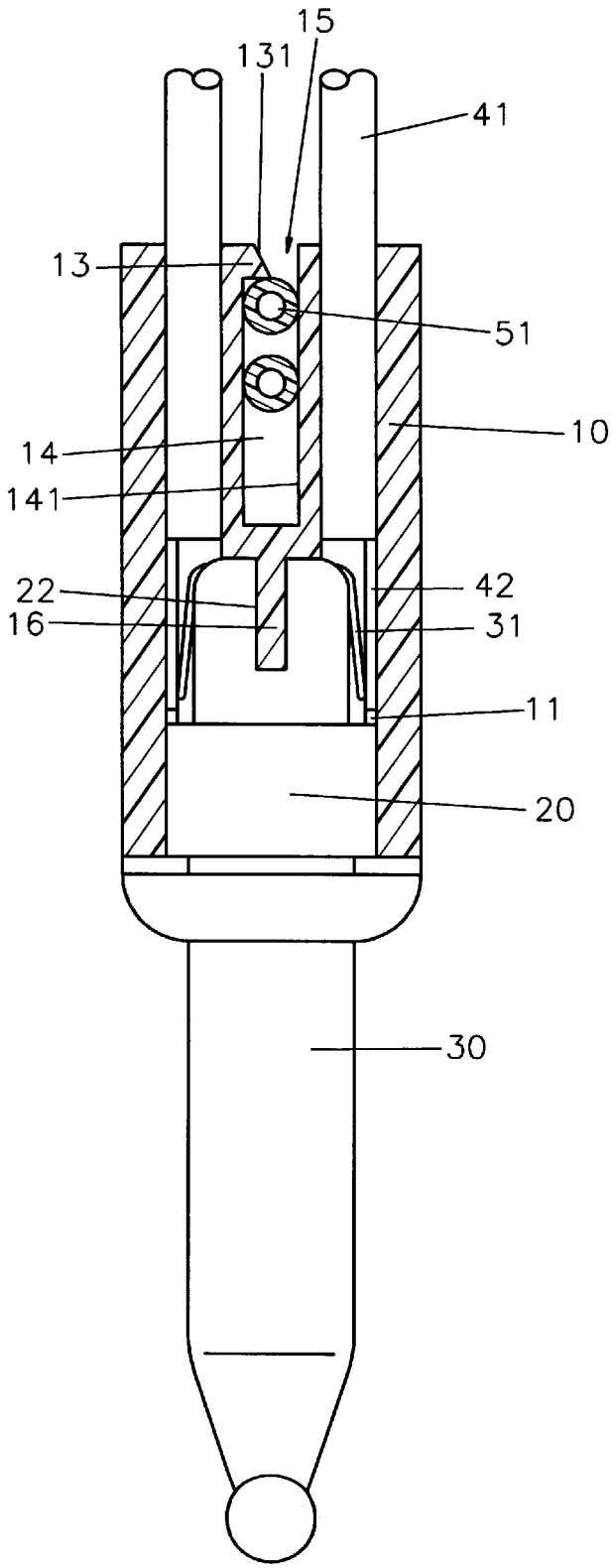
FIG. 5 is a sectional view of FIG. 4.

With feference to FIGS. 2 to 5, the suspensible christmas light of the present invention comprises generally a tubular receptacle 10 which includes a pair of longitudinal slots 11 in opposite inner walls for securing a pair of contact plates 42, a pair of electrical wires 41 inserted into a pair of longitudinal apertures 12 and respectively connected with the contact plates 42 for supplying electricity to the contact plates 42, an elongate notch 14 centrally formed in the rear end between the pair of apertures 12 to define a rectangular receiving space 141 for engaging with more than one linear object 51 such as the wires, cord or any other linear objects, a hook means 13 of triangular section formed at the opening of the notch 14 abutting one of the lateral side walls thereof so as to define a sloped narrow entrance 15 for the entry of the linear objects 51 and a partition 16 contrally projected forward relative to the receptacle 10 from the inner surface of the bottom of the receptacle 10, a tubular base 20 including a hollow interior for securing a bulb 30 therein and a roughly U-shaped protrusion centrally projected rearward from the bottom of the base 20 including a pair longitudinal thru holes 21 for respectively placing a pair of contact wires 31 which come from the bulb 30 and stopped their ends to the lateral sides of the U-shaped protrusion and a central notch 22 which is engageable with the partition 16 of the receptacle 10 when the base 20 embeds into the receptacle 10. For this arrangement, the pair of contact wires 31 are completely isolated to obviate any possible electrical shock inside the receptacle 10. FIG. 3 shows an assemblage of the christmas light of the present invention, where FIGS. 4 and 5 illustrate that more than one linear objects 51 are entered into the elongate notch 14 which means that the christmas light of the present invention enables to suspend more than one linear object therefrom.

It is under stood that the hook means 13 as well as the receptacle is made from flexible material in addition its sloped outer surface, thus the linear objects are very easy to enter into, However, once they are entered, they will be difficult to break away because of the flat surface of the hook means 13. Further, the side walls of the elongate notch 14 completely isolate the eletrical wires 41 of the receptacle 10 from the linear objects which are supposedly to be the returned electrical wires. This arrangement also obviate any possible hazard of electrical shock occurred to the notch 14.

Note that the specification relating to the above embodiment should be construed as exemplary rather than as limitative of the present invention, with many variations and modifications be readily attainable by a person of average skill in the art without departing from the spirit or scope thereof as defined by the appended claims and their legal equivalents.

I claim:

1. A Christmas light suspensible from at least one linear object comprising:

a tubular receptacle including a hollow interior, a pair of longitudinal slots in opposite inner walls for securing a pair of contact plates therein, a pair of electrical wires respectively connecting with the pair of contact plates and extending out of the receptacle through a pair of longitudinal apertures thereof, a partition centrally projected forward relative to the receptacle from an inner surface of a bottom of the receptacle and an elongate notch centrally formed in a rear end of the receptacle having hook means of triangular section extending transversely from a lateral wall abutting an opening of the notch so as to define a sloped narrow entrance here to for entry of said at least one linear object into said notch;

a tubular base insertible into the hollow interior of said receptacle, said base including a small hollow interior for embedding a bulb therein and a U-shaped protrusion centrally extending from a rear end of the base relative to the receptacle and having a pair of longitudinal thru holes in a pair of lateral portions of the U-shaped for engaging with a pair of contact wires which come from the bulb and have their ends stopped to lateral side of said U-shaped protrusion and engageable with the contact plates of said receptacle, and a central notch which is made engageable with the partition of said receptacle.

* * * * *